United States Patent [19]

Lawrence

[11] Patent Number: 4,688,539

[45] Date of Patent: Aug. 25, 1987

[54] MISSILE-LAUNCHING WEAPON

[76] Inventor: Howard L. Lawrence, 9816 E. 56th St., Indianapolis, Ind. 46236

[21] Appl. No.: 825,278

[22] Filed: Feb. 3, 1986

[51] Int. Cl.[4] ..... F41B 15/00

[52] U.S. Cl. ..... 124/27; 124/37; 124/41 R; 124/84; 124/DIG. 1

[58] Field of Search ..... 124/25, 35 R, 31, 26, 124/27, 41 R, 84

[56] References Cited

U.S. PATENT DOCUMENTS

| | | | |
|---|---|---|---|
| 2,714,884 | 8/1955 | Ickes | 124/35 R |
| 3,108,583 | 10/1963 | Andis | 124/25 |
| 3,204,625 | 9/1965 | Shepherd | 124/31 |
| 3,224,427 | 12/1965 | Ronan | 124/25 |
| 3,515,113 | 6/1970 | Lawrence | 124/25 |
| 3,538,901 | 11/1970 | Switack | 124/35 R |
| 3,812,833 | 5/1974 | Skillern | 124/35 R |
| 4,294,222 | 10/1981 | Pelsue | 124/35 R |
| 4,388,914 | 6/1983 | Cesin | 124/35 R |

FOREIGN PATENT DOCUMENTS

| | | | |
|---|---|---|---|
| 355712 | 7/1922 | Fed. Rep. of Germany | 124/26 |
| 2459310 | 6/1976 | Fed. Rep. of Germany | 124/25 |

*Primary Examiner*—Richard C. Pinkham
*Assistant Examiner*—Gary Jackson
*Attorney, Agent, or Firm*—Barnes & Thornburg

[57] ABSTRACT

An improved missile-launching weapon for launching either an arrow-type missile, a slug-type missile, or a plurality of shot-type pellets is provided. The weapon includes springs mounted in cooperation with pivotally mounted lever arms such that the lever arms can be moved to place the springs in and out of a loaded condition. The weapon also includes a removable guide that can be interchanged with a modified guide to allow the various types of missiles to be fired. A drive member is slidably mounted on the guide and is propelled by a cable extending between the springs. A trigger mechanism is mounted substantially near the center of gravity of the weapon to releasably latch the slide member in a cocked position. The trigger mechanism provides a proper amount of "feel" to the operator to allow the weapon to be fired accurately.

6 Claims, 9 Drawing Figures

MISSILE-LAUNCHING WEAPON

The present invention relates to a missile-launching weapon that is an improvement on the missile-firing weapon disclosed in applicant's U.S. Pat. No. 3,515,113 that issued on June 2, 1970. More particularly, the present invention relates to an improved missile-launching weapon that is capable of firing either an arrow-type missile, a slug-type missile, or a plurality of shot-type pellets.

Prior art devices of the type herein disclosed have several problems. One problem with the prior art devices is that generally the trigger is simply a catch mechanism that captures and retains a portion of a center pivoting rod. This type of trigger has two principal disadvantages. The first disadvantage is that such a trigger does not provide any "feel" for the operator. The trigger is simply pulled by the operator until it clears one end of the rod, and the weapon is fired. The second disadvantage of this type of trigger is that such a trigger is mounted below and slightly behind the drive member that propells the missile. This places the trigger well behind the center of gravity of the weapon. Because the hand grip must be oriented to encompass the trigger, the hand grip must therefore be well behind the center of gravity of the weapon. Thus, it is difficult, if not impossible, to hold the weapon with only one hand like a pistol.

Another problem with the prior art weapons is that the barrel, or launching rail, is fixed permanently to the frame, and is therefore not interchangeable. Thus, the prior art weapons are limited to firing an arrow or a slug.

Yet another problem with the prior art weapons is that the flexible cable that extends between the springs is mounted permanently to the springs. To replace such a cable requires specialized tools that are not normally carried by the weapon operator. Thus, if a cable breaks while hunting, the operator generally has no choice but to discontinue using the weapon.

It is an object of the present invention, therefore, to provide a missile-launching weapon that has a trigger assembly that provides an adequate "feel" for the operator to allow the weapon to be smoothly fired.

It is another object of the present invention to provide a missile-launching weapon that has a trigger mechanism mounted substantially near the center of gravity of the weapon to allow the weapon to be held and fired in one hand.

It is another object of the present invention to provide a missile-launching weapon that has interchangeable barrels or guides to allow a variety of individual missiles to be fired.

It is yet another object of the present invention to provide a missile-launching weapon in which the flexible cable that extends between the two springs is easily removable and replaceable.

According to the present invention, a missile-launching weapon is provided that includes a lower frame portion and a rearwardly mounted receiving portion mounted on the frame. A removable guide means is mounted on the frame and interfaces with the receiving portion to form a support for a missile to be launched. A support bar is mounted transversely on the frame and a pair of torsional springs, one attached to each end of the support bar. The springs each have a first arm and a second arm. A flexible cable extends between the first spring arms and is removably attached to each first spring arm. A device member is engaged by the cable for propelling the missile down the guide means. A lever arm is pivotally mounted within the frame and has a projection that extends upwardly to engage the drive member and to releasably secure the drive member in the cocked position. A finger operated trigger mounted within the frame to releasably support the lever arm in the position where the lever arm is securing the drive member in the cocked position. The trigger is pivoted progressively to a position where the lever arm is released and is forced downwardly by the drive member to release the drive member. A pair of levers, one mounted on each end of the support bar, are connected to the second arm of each of the torsional springs, respectively. Each lever is pivoted about its mounting axis to load the associated spring. Means are provided to releasably latch each lever in the spring loading position.

In preferred embodiments of the present invention, the guide means is adapted to launch an arrow-type missile, and the guide means is an elongated, rectangularly shaped member that has a slot formed longitudinally therein to receive one of the stabilizers of the arrow.

Also in preferred embodiments of the present invention, the guide means is adapted to launch a slug-type missile and the guide means has a longitudinally extending channel formed in it to receive and guide portion of the slug. One feature of the foregoing structure is that the guide means is easily interchangeable by the operator and each guide means is adapted specifically to launch one type of missile. One advantage of this feature is that the operator can choose the type of missile to be fired, and the appropriate guide means can be easily installed in the weapon to fire the corresponding type of missile. This allows the weapon to be less complicated than the prior art devices that were equipped to fire two types of missiles simultaneously. This also allows the weapon of the present invention to weigh less than the prior art devices that were equipped to fire two types of missiles.

Also in preferred embodiments of the present invention, the flexible cable is attached to the first arm of the torsional spring so that it is easily removable. One feature of the foregoing structure is that the cable is easily replaceable without the aid of tools. One advantage of this feature is that the operator can replace a broken cable while the weapon is in the area of use, such as, for example, while hunting in the field.

Also in preferred embodiments of the present invention, a pulley is attached to the end of each of the first spring arms. The flexible cable is attached by one of its ends to one arm of the support bar and is then routed through both of the pulleys, and then attached to the other arm of the support bar. One feature of the foregoing structure is that the torsional spring accelerates the drive member at a greater rate than if the cable is directly attached to the spring arm. One advantage of this feature is that the missile will be launched from the weapon at a greater speed than in other embodiments.

Additional objects, features, and advantages of the invention will become apparent to those skilled in the art upon consideration of the following detailed description of preferred embodiments exemplifying the best mode of carrying out the invention as presently perceived.

The detailed description particularly refers to the accompanying figures in which.

Figure 1:
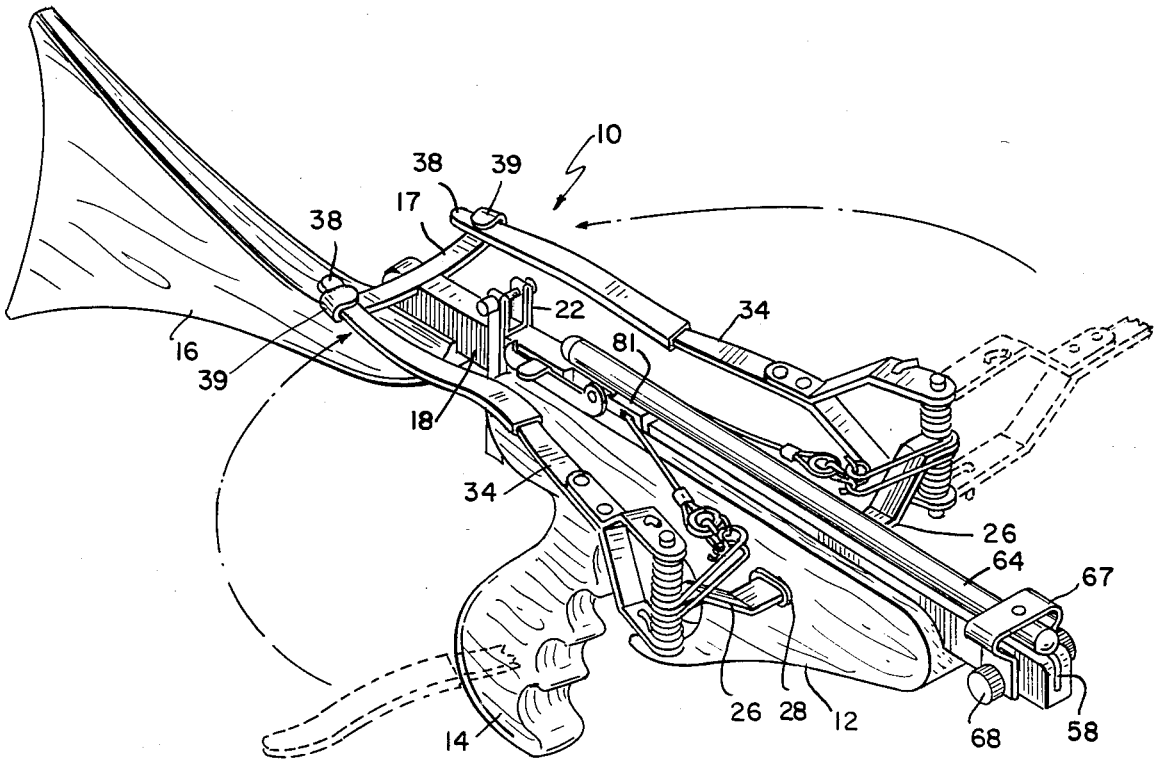
FIG. 1 is a top frontal perspective view of a missile-launching weapon of the present invention in a cocked, ready-to-fire configuration.
Figures 3, 4:
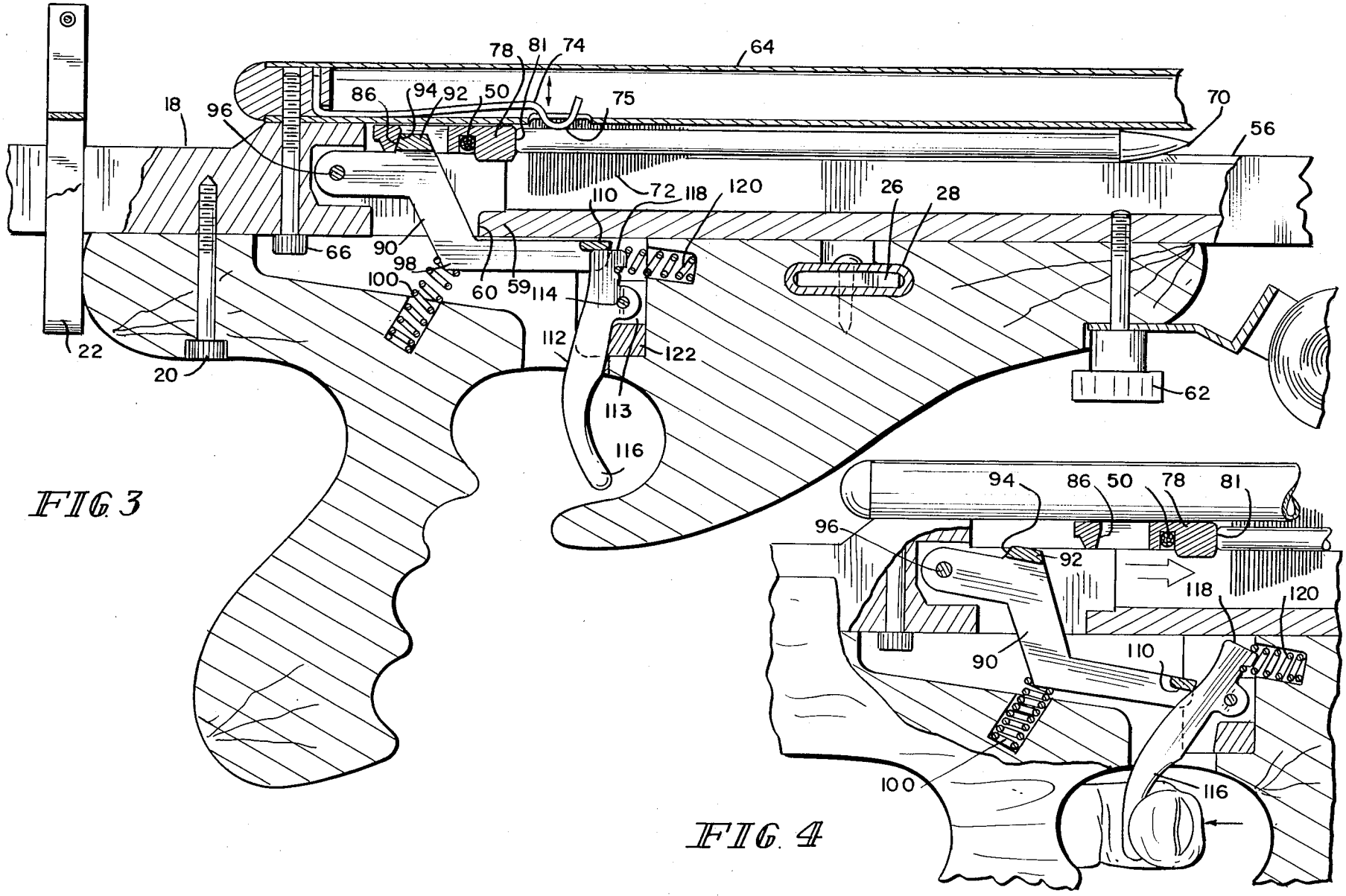
FIG. 3 is a partial transverse sectional view of the weapon shown in FIG. 1.
FIG. 4 is a partial transverse section of the weapon shown in FIG. 1 illustrating the trigger action as the weapon is fired.

Referring now to the drawings, and particularly to FIG. 1, a missile-launching weapon 10 is shown that includes a frame 12 having a hand grip 14 and a detachable stock 16. In the preferred embodiment, the frame is formed from wood, however other materials such as metal or high impact plastic could be used. The hand grip 14 is mounted substantially near the center of gravity of the weapon 10. A lever receiving unit 18 having transverse member 17 is mounted near the rearward end of the frame 12 by a screw 20 extending upwardly through the frame 12 into the receiving unit 18 (FIG. 3). An adjustable sight 22 is mounted on the receiving unit 18 to aid in aiming the weapon 10.

Figure 2:
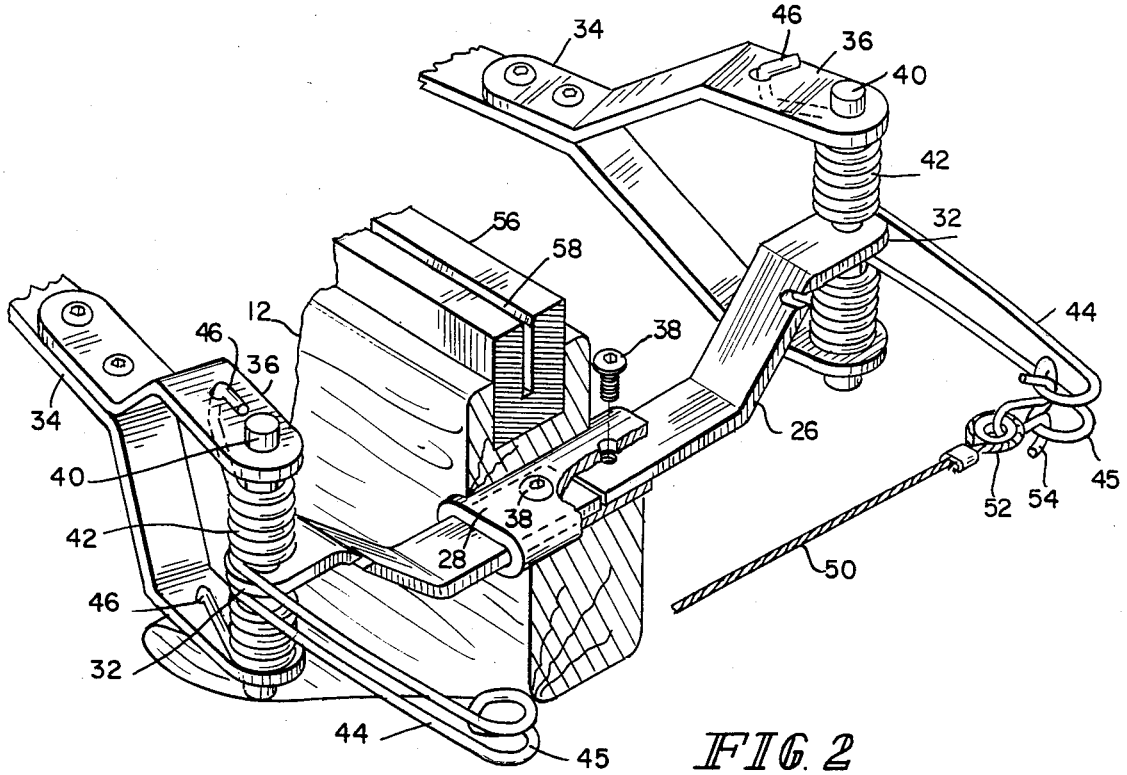
FIG. 2 is an enlarged partial perspective view of the weapon shown in FIG. 1 with portions broken away showing detail of the cross member with attached springs and lever arms as positioned after the weapon is fired.

A sleeve 28 is mounted transversely through the frame 12 and receives a cross member 26 that extends outwardly from the frame 12. The cross member 26 is attached to the sleeve 28 by screws 38, as best shown in FIG. 2. The cross member 26 terminates in opposing ends 32. A lever arm 34 is pivotally attached to each end 32 of the cross member 26. Each lever arm 34 includes a Y-shaped end 36 and an opposite end 38 (FIG. 1). The Y-shaped end 36 of each lever arm 34 is pivotally attached to one end 32 of the cross member 26 by a pin 40. Pin 40 is received in aligned holes of Y-shaped end 36 and cross member 26 to provide hinge-like attachment of each lever arm 34 and cross member 26. Hooks 39 are formed at each end of transverse member 17 of the receiving unit 18 for receiving and retaining the lever arms 34 in a position proximal to receiving unit 18 and substantially parallel to the line of trajectory of the weapon 10.

A spring 42 is disposed around each pin 40. Each spring 42 has a looped first portion 44 that terminates in a curved end 45. Each spring 42 also includes second portion 46 which is connected to the Y-shaped end 36 of each lever arm 34, as best shown in FIG. 2. The springs 42 are attached to the lever arms 34 in a manner that allows each spring 42 to be loaded and unloaded by movement of respective lever arm 34. When the lever arms 34 are in a position as shown in FIG. 1, the springs 42 are in a loaded condition. When the lever arms 34 are in a position as shown in dotted line in FIG. 1, the springs 42 are in an unloaded condition.

A flexible cable 50 having ends 52 with hooks 54 attached is connected to the curved end 45 of the first portion 44 of each spring 42. The cable 50 extends transversely to the frame 12 between first portions 44 of springs 42.

An elongated guide 56 is mounted on the frame 12 as shown in FIG. 3. The guide 56 includes a longitudinally extending groove 58 along its entire length (FIG. 2). A tongue 59 at the rearward end of the guide 56 is received in a notch 60 in the forward end of the receiving unit 18 to properly locate and secure the guide 56. The forward end of the guide 56 is secured to the frame 12 by a screw 62 that extends through the frame 12 into the guide 56 (FIG. 3).

An elongated retaining tube 64 is mounted over the receiving unit 18 and the guide 56. The retaining tube 64 is secured at its rearward end to the receiving unit 18 by a screw 66. The forward end of the retaining tube 64 is secured to a bracket 67 that is mounted on the guide 56 by a screw 68 (FIG. 1).

The retaining tube 64 and the guide 56 cooperate to secure an arrow-type missile 70 in the missile-launching weapon 10 (FIG. 3). The arrow-type missile 70 includes feathers 72, one of which is received by the groove 58 in the guide 56. A spring 74 is mounted in the retaining tube 64 with a curved end 75 extending through an aperture in the retaining tube 64. Curved end 75 of spring 74 contacts the rearward portion of the missile 70 to retain the missile 70 in the weapon 10.

Figure 6:
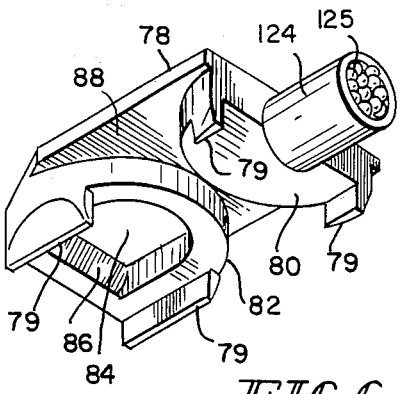
FIG. 6 is a perspective view of a modified slide member for launching a number of shot-type pellets.
Figure 9:
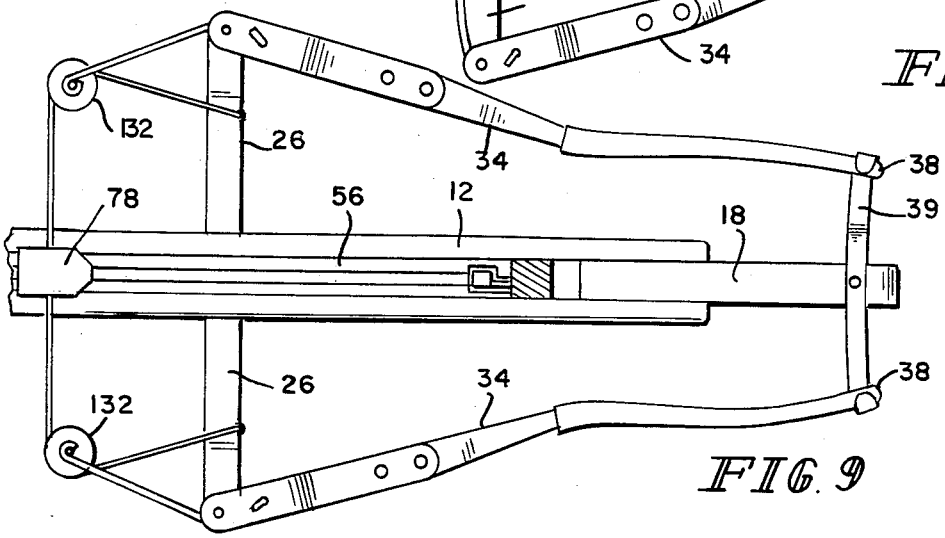
FIG. 9 is a partial top plan view of the weapon shown in FIG. 8 after it has been fired.

A slide member 78 having legs 79 and missile contacting surface 81 is mounted on the guide 56 for movement therealong. The slide member 78 includes on its underside a semi-circular front portion 80 and a semi-circular rear portion 82 (FIG. 6). A depression 84 is formed in the semi-circular rear portion 82 that includes a forwardly facing surface 86. The legs 79 of the slide member 78 engage the edges of the guide 56 to guide the slide member 78 along the guide 56. A channel 88 is (FIG. 6) formed by the cooperation of the semi-circular front portion 80 and the semi-circular rear portion 82. The cable 50 extends through the channel 88 when the slide member 78 is mounted on the guide 56. The slide member 78 is movable along the guide 56 between a rearward cocked position illustrated in FIG. 1 and an uncocked position, e.g. as shown in FIG. 9, to launch a missile, such as the arrow-type missile 70. The slide member 78 is propelled from the cocked position to the uncocked position by the cable 50 under the influence of loaded springs 42. The springs 42 provide a significant missile launching force on the cable 50 when the springs 42 are loaded using lever arms 34.

Referring now to FIG. 3, a slide member retaining arm 90 is pivotally mounted on the receiving unit 18. The retaining arm 90 includes an upwardly extending projection 92 having a rearwardly facing surface 94. The surface 94 is oriented to cooperate with the forwardly facing surface 86 of the slide member 78 to retain the slide member 78 in the cocked position. Both the surface 86 and the surface 94 are angled so that a force applied to the slide member 78 by the cable 50 in the forward direction (toward the foward part of the weapon 10) is translated into a downward force on the arm 90. The interaction of the angled surfaces 86 and 94 thereby biases the arm 90 downwardly away from the slide member 78 and into a slide member releasing position.

A pivot pin 96 is mounted in the receiving unit 18 and extends through the retaining arm 90 to allow the retaining arm 90 to pivot from an upward slide member-engaging/retaining position to a downward slide member-releasing position. A spring 100 is mounted in the frame 12 and cooperates with retaining arm 90 to bias the pivotally mounted arm 90 to the upward position.

The retaining arm 90 also includes a tab 110 that engages the upper portion of a trigger 112. The trigger 112 is pivotally mounted in a mounting block 113 by a pin 114. The mounting block 113 and trigger 112 are removable from the frame 12 if necessary. The trigger 112 includes a finger engaging portion 116 that extends out of the frame 12 adjacent the hand grip 14. The trigger 112 also includes at its upper end an edge 118 that engages the tab 110 of the slide member retaining arm 90. A spring 120 is mounted in the frame 12 and engages the upper portion of the trigger 112 to bias the trigger 112 to a position where the edge 118 will engage the tab 110. A stop 122 is included in the mounting block 113 to properly position the upper edge 118 of trigger 112 with respect to the tab 110 of the retaining arm 90.

The biasing force provided by the spring 100 not only works to properly position projection 92 of the retaining arm 90 for engagement with the slide member 78, but also works to position tab 110 for engagement with edge 118 of trigger 112. The downward force imposed on the retaining arm 90 by the slide member 78 will overcome the spring 100 biasing force to move the retaining arm 90 downwardly when edge 118 clears tab 110 as the trigger 112 is pulled.

Referring now to FIG. 6, a pocket 124 is shown attached to the forward end of the slide member 78. The pocket 124 is formed to receive shot-like pellets 125 that may be launched by the weapon 10 as will be discussed below.

Figure 7:
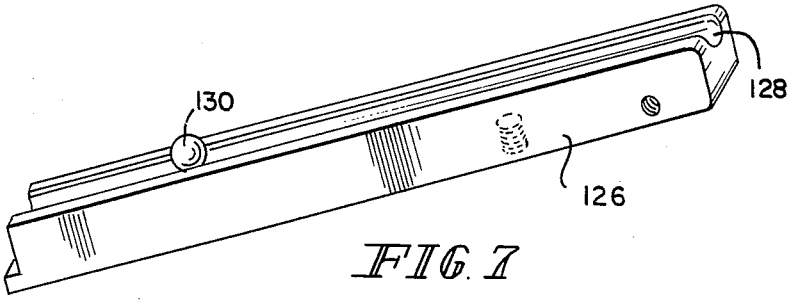
FIG. 7 is a perspective view of a modified guide for launching a slug-type missile.

Referring now to FIG. 7, a modified guide 126 is shown that includes a longitudinally extending channel 128. The channel 128 is formed to receive a slug-type missile 130 that may be launched from the weapon 10. It will be understood that the guide 126 is mounted in the frame 12 in an identical manner to guide 56. Guide 126 can be used advantageously with the slide member 78 illustrated in FIG. 6. The channel 128 receives a portion of the pocket 124.

Figure 8:
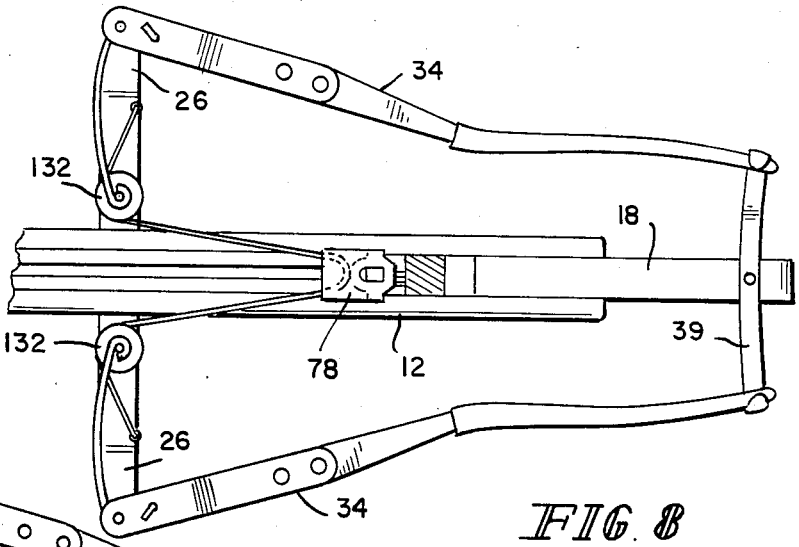
FIG. 8 is a partial top plan view of another weapon of the present invention in a cocked ready-to-fire configuration.

Referring now to FIGS. 8 and 9, a modification of the present invention is shown. A pulley 132 is shown mounted on the end 45 of the first portion 44 of each spring 42. The cable 50 is attached at one end 52 to one side of the cross member 26, and then routed around one of the pulleys 132 and through the slide member 78, around the other pulley 132 and then attached at its other end 52 to the opposite side of cross member 26. The addition of the pulleys 132 provides added mechanical advantage for propelling the slide member 78. Thus the springs 42 are able to impart a greater velocity to the slide member 78 (and therefore, to any projectile).

In operation, the lever arms 34 of the weapon 10 are initially pivoted outwardly from the frame 12 to a position generally perpendicular to the frame 12. This position is shown in dotted line in FIG. 1. With the lever arms 34 in this position, the springs 42 are unloaded, thus no tension is applied to the cable 50. The slide member 78 may be easily pulled rearwardly into the cocked position where the projection 92 of the retaining arm 90 will contact the surface 86 of the slide member 78. Thus, the slide member 78 is releasably latched in the cocked position by the retaining arm 90. The lever arms 34 are then rotated toward the frame 12 to load the springs 42. The ends 38 of the lever arms 34 are engaged in the hooks 39 to retain the lever arms 34 in the spring loaded position. This orientation of the lever arms 34 is best shown in FIG. 1. An arrow-type missile 70 is then inserted into the weapon 10 between the guide 56 and the retaining tube 64 and pushed rearwardly such that the rear portion of the missile 70 contacts the missile engaging surface 81 of slide member 78. The missle-launching weapon 10 is then ready for firing.

To fire the weapon 10, the finger engaging portion 116 of the trigger 112 is pulled by the operator until the edge 118 of the trigger 112 clears tab 110 of the retaining arm 90. Once the tab 110 is clear of the edge 118 of the trigger 112, the downward force on the retaining arm 90 imposed by the angled surface 86 of slide member 78 against surface 94 of projection 92 forces the retaining arm 90 downwardly to disengage the slide member 78, i.e., where suface 94 clears surface 86. The slide member 78 is then propelled forwardly by the force on the cable 50 imposed by the loaded springs 42. The missile 70 is propelled away from the weapon 10 toward the intended target.

Figure 5:
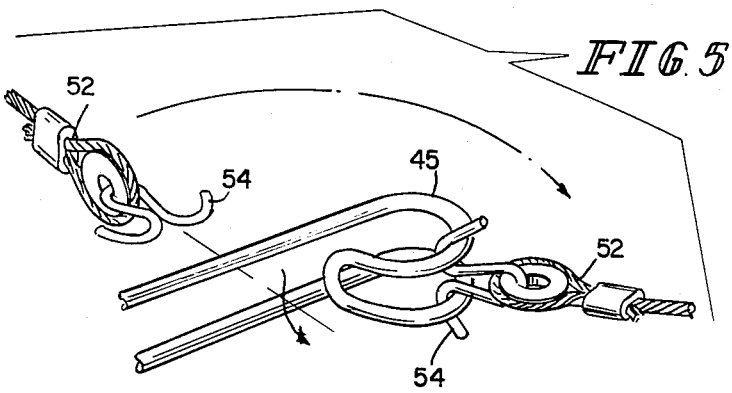
FIG. 5 is a partial view showing the cable attached to the spring.

To replace a cable 50, the lever arm 34 are first disengaged from the hooks 39 and moved outwardly away from the frame 12 to the position shown in dotted line in FIG. 1. This unloads the springs 42 and releases all tension from the cable 50. The hooks 54 on the ends 52 of the cable 50 may then be disengaged from the first portions 44 of the springs 42 as shown in FIG. 5. A new cable 50 can be attached to the springs 42 in the reverse manner.

To launch a slug-type missile 130 as shown in FIG. 7, the guide 126 must be installed in the weapon 10. The guide 56 is removed from the weapon 10 simply by disengaging the screw 62 from the guide 56, and then pulling the guide 56 outwardly from the frame 12. The guide 126 is installed in the reverse manner. The weapon 10 is then cocked, as described previously, and the slug-type missile 130 is then placed in the channel 128 and moved to a position where it is in contact with the slide member 78 and spring 74. When the trigger 112 is squeezed, the slug-type missile will be launched from the weapon 10 much like the missile 70.

In order to use the slide member 78 with the pocket 124 attached, as shown in FIG. 6, the guide 126 is first installed in the weapon 10. The pocket 124 is formed to be received by the channel 128, much like the slug-type missile 130. The weapon 10 is cocked, and pellets 125 are loaded into the pocket 124. When the trigger 112 is squeezed, the slide member 78 is propelled forwardly, launching the pellets 125.

Although the invention has been described in detail with reference to preferred embodiments and specific examples, variations and modifications exist within the scope and spirit of the invention as described and defined in the following claims.

What is claimed is:

1. A missile-launching weapon comprising:

an elongated frame;

a drive member control unit rearwardly mounted on said frame;

first and second interchangeable missile guide means, said first and second guide means both having a forward end and a rearward end and formed to support a missile for movement therealong, said rearward ends being interchangeably received by the drive member control unit, each of said first and second guide means being formed from an elongated, rectangularly shaped member and having a longitudinal groove formed therein to receive a portion of said missile;

a support bar mounted transversely on said frame and having opposite ends extending laterally from said frame;

a pair of torsional springs, one attached to each end of said support bar, each of said springs having a first arm and a second arm;

a cable releasably attached to each first spring arm and extending therebetween;

a sliding drive member for propelling said missile along either of said guide means, said drive member including downwardly extending legs for slidably engaging either of said guide means for longitudinal movement therealong, said drive member engaged by said cable and movable between a rearward cocked position over the drive member control unit and a forward position over either of the guide means and said drive member formed to include a missile contacting surface, a guide means contacting surface, a cable receiving groove and a forwardly facing angled surface, said cable receiving groove located in a common reference plane with the first spring arms to prevent any upward or downward force from being exerted on the drive member;

a retaining tube mounted in a spaced apart, parallel relation to said guide means above said guide means for retaining said missile in said guide means;

a control arm having a rearward end and a forward end, the rearward end pivotally mounted in said drive member control unit, and having an upwardly extending projection intermediate said forward and rearward ends adapted to engage the forwardly facing angled surface of said drive member when said drive member is in the rearward cocked position to releasably latch said drive member in that position;

a pivotally mounted trigger having a lower finger receiving surface and an upper edge for releasably supporting the forward end of the control arm to hold the projection on said arm in engagement with the forwardly facing surface of the drive member, said trigger pivotable between a position where said forward end of said control arm is supported by said upper edge and a position where the forward end of said control arm is released to allow disengagement of said projection and said drive member and further allowing said drive member to drive said missile along said guide means;

a pair of levers, one lever mounted on each end of said support bar, one of said levers being connected, at a point spaced from its mounting, to the second arm of one of said springs and the other of said levers being connected, at a point spaced from its mounting, to the second arm of the other of said springs, each of said levers being pivotable to load its associated spring; and means releasably latching said levers in spring loading positions.

2. The missile-launching weapon of claim 1, wherein said missile is an arrow having stabilizer means near one end, and wherein said groove in said first guide means is a generally rectangularly shaped, horizontally extending slot that is formed to receive one of said stabilizer means.

3. The missile-launching weapon of claim 1, wherein said missile is a generally spherically shaped slug, and wherein said groove in said second guide means is a generally semi-circular shaped, longitudinally extending channel formed to receive a portion of said slug.

4. The missile-launching weapon of claim 1, wherein said missile contacting surface is a cylindrical shaped receptacle mounted on the forward edge of said drive member and adapted to receive a plurality of shot pellets and oriented to propel said pellets when said drive member is propelled toward its forward position.

5. The missile-launching weapon of claim 1, further comprising a pair of pulleys, one attached to the end of each of said first spring arms, and wherein said cable is attached to said support bar substantially near each end portion and is routed through the pair of pulleys and extends therebetween.

6. A missile-launching device for launching either an arrow-type missile or a slug-type missile, the device comprising, an elongated frame, first and second interchangeable missile guide means, said first missile guide means configured to support said arrow-type missile, said second missile guide means configured to support said slug-type missile, a drive member control unit rearwardly mounted on said frame, said drive member control unit configured to intechangeably receive one of said first or second missile guide means, a support bar mounted transversely on said frame and having opposite ends extending laterally from said frame;

a pair of torsional springs, one attached to each end of said support bar, each of said springs having a first arm and a second arm;

a cable releasably attached to each first spring arm and extending therebetween;

a sliding drive member for propelling said missile along either of said guide means, said drive member including downwardly extending legs for slidably engaging either of said guide means for longitudinal movement therealong, said drive member engaged by said cable and movable between a rearward cocked position over the drive member control unit and a forward position over either of the guide means and said drive member formed to include a missile contacting surface, a guide means contacting surface, a cable receiving groove and a forwardly facing angled surface, said cable receiving groove located in a common reference plane with the first spring arms to prevent any upward or downward force from being exerted on the drive member;

a retaining tube mounted in a spaced apart, parallel relation to said guide means above said guide means for retaining said missile in said guide means;

a control arm having a rearward end and a forward end, the rearward end pivotally mounted in said drive member control unit, and having an upwardly extending projection intermediate said forward and rearward ends adapted to engage the forwardly facing angled surface of said drive member when said drive member is in the rearward cocked position to releasably latch said drive member in that position;

a pivotally mounted trigger having a lower finger receiving surface and an upper edge for releasably supporting the forward end of the control arm to hold the projection on said arm in engagement with the forwardly facing surface of the drive member, said trigger pivotable between a position where said forward end of said control arm is supported by said upper edge and a position where the forward end of said control arm is released to allow disengagement of said projection and said drive member and further allowing said drive member to drive said missile along said guide means;

a pair of levers, one lever mounted on each end of said support bar, one of said levers being connected, at a point spaced from its mounting, to the second arm of one of said springs and the other of said levers being connected, at a point spaced from its mounting, to the second arm of the other of said springs, each of said levers being pivotable to load its associated spring; and means releasably latching said levers in spring loading positions.

* * * * *